US007937911B1

(12) United States Patent
McGonagle et al.

(10) Patent No.: US 7,937,911 B1
(45) Date of Patent: May 10, 2011

(54) METHOD OF PREPARING A BLISTER CARD

(75) Inventors: Sean McGonagle, Buffalo Grove, IL (US); Greg Pankow, Morton Grove, IL (US)

(73) Assignee: Walgreen Co., Deerfield, IL (US)

( * ) Notice: Subject to any disclaimer, the term of this patent is extended or adjusted under 35 U.S.C. 154(b) by 159 days.

(21) Appl. No.: 12/275,773

(22) Filed: Nov. 21, 2008

(51) Int. Cl.
*B65B 3/04* (2006.01)

(52) U.S. Cl. ..... 53/452; 53/453; 53/456; 53/443; 53/447; 53/539; 53/158; 53/52

(58) Field of Classification Search ..... 53/452–454, 53/456, 467, 51–52, 235, 244, 246, 158, 53/531, 539, 544, 443, 447
See application file for complete search history.

(56) References Cited

U.S. PATENT DOCUMENTS

| | | | | |
|---|---|---|---|---|
| 3,069,273 | A | | 12/1962 | Wayne |
| 3,283,885 | A | | 11/1966 | Grunewald et al. |
| 3,503,493 | A | | 3/1970 | Nagy |
| 3,737,029 | A | | 6/1973 | Serrell et al. |
| 3,780,856 | A | | 12/1973 | Braverman |
| 3,924,748 | A | | 12/1975 | Braverman |
| 4,120,399 | A | | 10/1978 | Clarke |
| 4,196,809 | A | | 4/1980 | Tonrey |
| 4,233,799 | A | * | 11/1980 | Caille ..... 53/154 |
| 4,254,601 | A | * | 3/1981 | Prager et al. ..... 53/133.8 |
| 4,295,567 | A | | 10/1981 | Knudsen et al. |
| 4,340,141 | A | | 7/1982 | Fischer |
| 4,362,000 | A | * | 12/1982 | Poore ..... 53/411 |
| 4,428,709 | A | | 1/1984 | Peters |
| 4,437,579 | A | | 3/1984 | Obland |
| 4,844,246 | A | | 7/1989 | Harrison et al. |
| 4,860,899 | A | | 8/1989 | McKee |
| 4,889,236 | A | | 12/1989 | Bartell et al. |
| 4,909,414 | A | | 3/1990 | Heath |
| 4,955,481 | A | | 9/1990 | Novinski et al. |
| 4,975,015 | A | | 12/1990 | Harding |
| 5,009,894 | A | | 4/1991 | Hsiao |
| 5,014,851 | A | | 5/1991 | Wick |
| 5,050,739 | A | | 9/1991 | Hannan et al. |

(Continued)

FOREIGN PATENT DOCUMENTS

WO WO-03/076303 9/2003

(Continued)

OTHER PUBLICATIONS

DISPILL systeme de distribution de medicaments, "Pour Les Pharmaciens," Retrieved from the Internet on Oct. 8, 2008. URL:http://www.dispill.com/plateaux.html.

(Continued)

*Primary Examiner* — Christopher Harmon
(74) *Attorney, Agent, or Firm* — Francis C. Kowalik; Marshall, Gerstein & Borun LLP

(57) ABSTRACT

A method of preparing a blister card to contain medicaments in accordance with a predetermined prescription, comprises positioning a blister sheet blank having a plurality of blisters onto a support surface of a fixture. Each of the blisters are then at least partially filled with one or more medicaments in accordance with the predetermined prescription. Then, a backing layer blank is positioned over the blister sheet blank to retain the medicaments in the blisters and to prevent contamination. Finally, the blister sheet blank and the backing layer blank are sealed together while positioned on the fixture to form a sealed blister card.

15 Claims, 11 Drawing Sheets

U.S. PATENT DOCUMENTS 5,265,728 A 11/1993 Allendorf et al.
5,323,907 A 6/1994 Kalvelage
5,377,836 A 1/1995 Eisenbraun
5,431,283 A 7/1995 Weinstein et al.
5,460,471 A 10/1995 Connor et al.
5,509,773 A 4/1996 Connor et al.
5,549,204 A 8/1996 Toren et al.
5,564,593 A 10/1996 East, Sr.
5,685,420 A 11/1997 Martin et al.
5,740,717 A 4/1998 Sowden et al.
5,788,079 A 8/1998 Bouthiette et al.
5,915,559 A 6/1999 Hulick et al.
5,954,202 A 9/1999 Mellon
6,021,623 A 2/2000 Bouthiette et al.
6,023,916 A 2/2000 Bouthiette et al.
6,024,222 A 2/2000 Friberg et al.
6,024,247 A 2/2000 Birr et al.
6,155,423 A 12/2000 Katzner et al.
6,206,233 B1 3/2001 Schulze
6,219,997 B1 4/2001 Friberg et al.
6,244,462 B1 6/2001 Ehrensvard et al.
6,318,051 B1 11/2001 Preiss et al.
6,349,831 B1 2/2002 Buss
6,382,412 B1 5/2002 Wood
6,382,420 B1 5/2002 Bouthiette et al.
6,412,636 B1 7/2002 Jones et al.
6,550,618 B2 4/2003 Peterson
6,557,740 B1 5/2003 Dent
6,628,199 B1 9/2003 Ehrensvard et al.
6,652,215 B1 11/2003 Parker et al.
6,681,935 B1 1/2004 Lewis
6,698,425 B1 3/2004 Widerstrom et al.
6,752,272 B2 6/2004 Jones et al.
6,802,422 B2 10/2004 Kalvelage et al.
6,848,580 B2 2/2005 Paliotta et al.
6,925,774 B2 * 8/2005 Peterson ..... 53/152
6,951,282 B2 10/2005 Jones
6,964,338 B2 11/2005 Kancsar et al.
6,978,894 B2 12/2005 Mundt
6,997,320 B1 2/2006 Kancsar et al.
6,997,344 B2 2/2006 Brown et al.
7,000,768 B2 2/2006 Morita et al.
7,021,492 B2 * 4/2006 Priebe et al. ..... 221/296
7,055,294 B1 6/2006 Lewis
7,063,211 B2 6/2006 Williams-Hartman
7,090,079 B2 8/2006 Ehrlund et al.
7,126,879 B2 10/2006 Snyder
7,188,728 B2 3/2007 Williams-Hartman
7,225,597 B1 * 6/2007 Knoth ..... 53/246
7,308,984 B2 12/2007 Bouthiette et al.
7,334,379 B1 * 2/2008 Siegel et al. ..... 53/55
7,336,564 B2 2/2008 Feodoroff et al.
2002/0045184 A1 4/2002 Chen
2002/0104773 A1 8/2002 Kalvelage et al.
2003/0031595 A1 2/2003 Kirchhevel et al.
2003/0032190 A1 2/2003 Brown et al.
2003/0034271 A1 2/2003 Burridge
2004/0026293 A1 2/2004 Hughes
2004/0069675 A1 4/2004 Stevens
2004/0108240 A1 6/2004 Ragot
2004/0188315 A1 9/2004 Morita et al.
2005/0082194 A1 4/2005 Fry et al.
2005/0102838 A1 5/2005 Leason
2005/0112194 A1 5/2005 Gervais et al.
2005/0178692 A1 8/2005 Chang
2005/0210682 A1 9/2005 Bartholin
2005/0269238 A1 12/2005 Reape et al.
2005/0274643 A1 12/2005 Arnold
2005/0274644 A1 12/2005 Williams-Hartman
2006/0021900 A1 2/2006 Feodoroff
2006/0042987 A1 3/2006 Buss
2006/0060597 A1 3/2006 Stevens
2006/0144749 A1 7/2006 Arnold et al.
2006/0249420 A1 11/2006 Hession
2006/0289328 A1 12/2006 Hession
2007/0045149 A1 3/2007 Hession
2007/0048413 A1 3/2007 Glydon
2007/0056876 A1 3/2007 Jones
2007/0084746 A1 4/2007 Udo et al.
2007/0084747 A1 4/2007 Gherdan et al.
2007/0125679 A1 6/2007 Smith
2007/0205131 A1 9/2007 Bouthiette
2007/0205132 A1 9/2007 Bouthiette
2007/0205133 A1 9/2007 Valentine et al.
2007/0284280 A1 12/2007 Young
2008/0023366 A1 1/2008 Bouthiette
2008/0110791 A1 5/2008 Specker

FOREIGN PATENT DOCUMENTS

WO WO-2005/110889 11/2005

OTHER PUBLICATIONS

Medicine-On-Time, "Home page," Retrieved from the Internet on Oct. 8, 2008. URL:http://www.medicine-on-time.com.

MTS Medication Technologies, "Sureseal™," Retrieved from the Internet on Oct. 8, 2008. URL:http://www.mts-mt.com/index.php?module=NukeWrapper&url=/products/machine.html?idx=13.

* cited by examiner

METHOD OF PREPARING A BLISTER CARD

FIELD OF THE INVENTION

The present disclosure is generally related to a method and apparatus of preparing medicament blister cards and, more particularly, for preparing a plurality of multi-dose blister cards to accommodate a specific patient prescription.

BACKGROUND

Blister cards are often used to store medicaments such as prescriptions and/or over the counter drugs, vitamins, etc. Some blister cards are configured such that each blister carried by the card stores a single dose of a certain medicament. For example, some traditional cold medicines are offered in blister cards, whereby each blister contains a single dosage, e.g., one or two capsules. Such blister cards are conventionally filled and sealed using an automated process.

Other blister cards are configured as multi-dose blister cards, whereby each blister stores any number of medicaments that are to be ingested by the patient simultaneously, and at some predetermined time of day, for example. Multi-dose blister cards can simplify the ingestion of medications for patients that have been prescribed multiple drugs and/or vitamins, for example, by reducing the number of packages the patient must access to obtain the medicaments.

The process of filling and sealing multi-dose blister cards is more complicated than single-dose blister cards because each patient foreseeably requires a unique prescription medication/combination. Therefore, these multi-dose blister cards are most often filled manually by a pharmacist or a pharmaceutical technician. Once filled, the contents of the multi-dose blister card is typically verified against the patient's prescription to ensure the patient is receiving the appropriate medicaments, and then the card is sealed and delivered. This process can be tedious, time-consuming, and costly.

SUMMARY

One aspect of the present disclosure provides method of preparing a blister card using a fixture to contain medicaments in accordance with a predetermined prescription. The method includes positioning a blister sheet blank having a plurality of blisters onto a support surface of a fixture. The method also includes filling at least a portion of each of the blisters of the blister sheet blank with one or more medicaments in accordance with a predetermined prescription. The method also includes positioning a backing layer blank over the blister sheet blank to retain the medicaments in the blisters and to prevent contamination. The method also includes inserting the fixture into a sealing apparatus. The method further includes sealing the blister sheet blank and the backing layer blank together while positioned on the fixture.

In one embodiment, positioning the blister sheet blank includes aligning each of a plurality of openings in the blister sheet blank with one of a plurality of pins extending from the fixture.

In one embodiment, the method further includes printing the backing layer blank with information specific to the predetermined prescription prior to positioning the backing layer blank on the blister sheet blank.

In one embodiment, sealing the blister sheet blank and the backing layer blank together includes applying at least one of heat and pressure to the backing layer blank, blister sheet blank, and fixture.

In another embodiment, the method further includes trimming the sealed backing layer blank and blister sheet blank to a predetermined shape, thereby defining a backing layer and blister sheet of a completed blister card.

In another embodiment, the method further includes covering the blister sheet blank with a cover after filling the blisters.

In another embodiment, the method further includes reading information from at least one data storage mechanism on at least one of the fixture, the blister sheet blank, and the backing layer blank to confirm that each of these components match the predetermined prescription prior to sealing the blister sheet blank and the backing layer blank together.

In another embodiment, the method further includes positioning a structure board blank having a plurality of apertures onto the support surface of the fixture prior to positioning the blister sheet blank onto the support surface.

In one embodiment, positioning the blister sheet blank includes aligning the plurality of blisters of the blister sheet blank to extend through the plurality of apertures in the structure board blank.

In another embodiment, the method further includes sealing the structure board blank and the blister sheet blank together simultaneously with sealing the blister sheet blank and the backing layer blank together.

Another aspect of the present disclosure provides a method of preparing a blister card using a fixture to contain medicaments in accordance with a predetermined prescription. The method first includes aligning a plurality of blisters of a blister sheet blank with a plurality of depressions formed in a top surface of a support plate of a fixture. The method also includes filling at least some of the blisters of the blister sheet blank ith one or more medicaments. The method also includes covering the blister sheet blank with a backing layer blank. The method also includes applying at least one of pressure and heat to the backing layer blank, the blister sheet blank, and the fixture to seal the backing layer blank and the blister sheet blank together.

In one embodiment, aligning the plurality of blisters in the blister sheet blank with the plurality of depressions includes positioning one or more openings formed in the blister sheet blank onto one or more pins extending from the fixture.

In another embodiment, the method further includes printing information specific to the prescription on the backing layer blank prior to covering the blister sheet blank with the backing layer blank.

In another embodiment, the method further includes trimming the sealed backing layer blank and the blister sheet blank to a predetermined shape, thereby defining a backing layer and blister sheet of a completed blister card.

In another embodiment, the method further includes reading information from at least one data storage mechanism on at least one of the fixture, the blister sheet blank, and the backing layer blank to confirm that each of these components match the predetermined prescription prior to sealing the backing layer blank and the blister sheet blank together.

In another embodiment, the method further includes aligning a plurality of apertures of a structure board blank with the plurality of depressions in the top surface of the support plate of the fixture prior to aligning the plurality of blisters of the blister sheet blank with the plurality of depressions.

In one embodiment, aligning the plurality of blisters of the blister sheet blank with the plurality of depressions in the fixture includes positioning the plurality of blisters through the plurality of apertures in the structure board blank.

A still further aspect of the present disclosure includes a method of preparing a plurality of blister cards to contain medicaments according to a predetermined prescription. This method includes selecting a first fixture having a support plate. This method further includes positioning a first blister sheet blank having a first plurality of blisters onto the support plate of the first fixture. This method further includes at least partially filling at least some of the first plurality of blisters of the first blister sheet blank with medicaments. This method further includes selecting a second fixture having a support plate. This method further includes locating the second fixture onto the first fixture such that the support plate of the second fixture covers the first blister sheet blank to prevent contamination and to retain the medicaments in the first plurality of blisters. This method further includes positioning a second blister sheet blank having a second plurality of blisters onto the support plate of the second fixture. This method further includes at least partially filling at least some of the second plurality of blisters of the second blister sheet blank with medicaments. This method further includes covering the second blister sheet blank to prevent contamination and to retain the medicaments in the second plurality of blisters.

In one embodiment, locating the second fixture onto the first fixture includes positioning one of a projection and a recess of the second fixture in cooperative engagement with the other of a projection and a recess of the first fixture.

In one embodiment, locating the second fixture onto the first fixture further includes engaging the first blister sheet blank with a bottom surface of the support plate of the second fixture.

In one embodiment, positioning the first and second blister sheet blanks onto the first and second structure board blanks, respectively, includes aligning at least one opening formed in the first and second blister sheet blanks with at least one pin extending from the first and second fixtures.

In another embodiment, the method further includes covering the second blister sheet blank with a second backing layer blank and applying at least one of heat and pressure to the second backing layer blank, the second blister sheet blank, and the second fixture, thereby sealing these components together to form a sealed blister card.

In still another embodiment, the method further includes trimming the sealed second backing layer blank and second blister sheet blank to a predetermined shape, thereby defining a backing layer and blister sheet of a completed blister card.

DETAILED DESCRIPTION OF THE PREFERRED EMBODIMENTS

Although the following text sets forth a detailed description of numerous different embodiments, it should be understood that the legal scope of the invention is defined by the language of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of the patent application from which this patent issued, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the phrase "means for" and a function without the recital of any structure, it is not intended that the scope of any claim element be interpreted based on the application of 35 U.S.C. §112, sixth paragraph.

The present disclosure concerns a method and an apparatus for preparing blister cards such as multi-dose blister cards for delivery to a patient. Preparing blister cards generally includes filling the blister cards with one or more medicaments, and subsequently sealing the blisters to prevent contamination of the contents. Additionally, the preparation process can include various aspects of preparing the filled blister card for delivery to a patient or other consumer.

As will be described with reference to FIGS. 3-6, the present disclosure provides a simple, effective, and efficient solution to preparing one or more blister cards through the use of fixtures 100, one embodiment of which is shown in perspective view in FIG. 3. As will be described, the fixtures 100 are configured to safely and temporarily store blister cards during the preparation process and are designed to minimize contamination, increase organization, and optimize the accuracy of the entire process.

Figure 1:
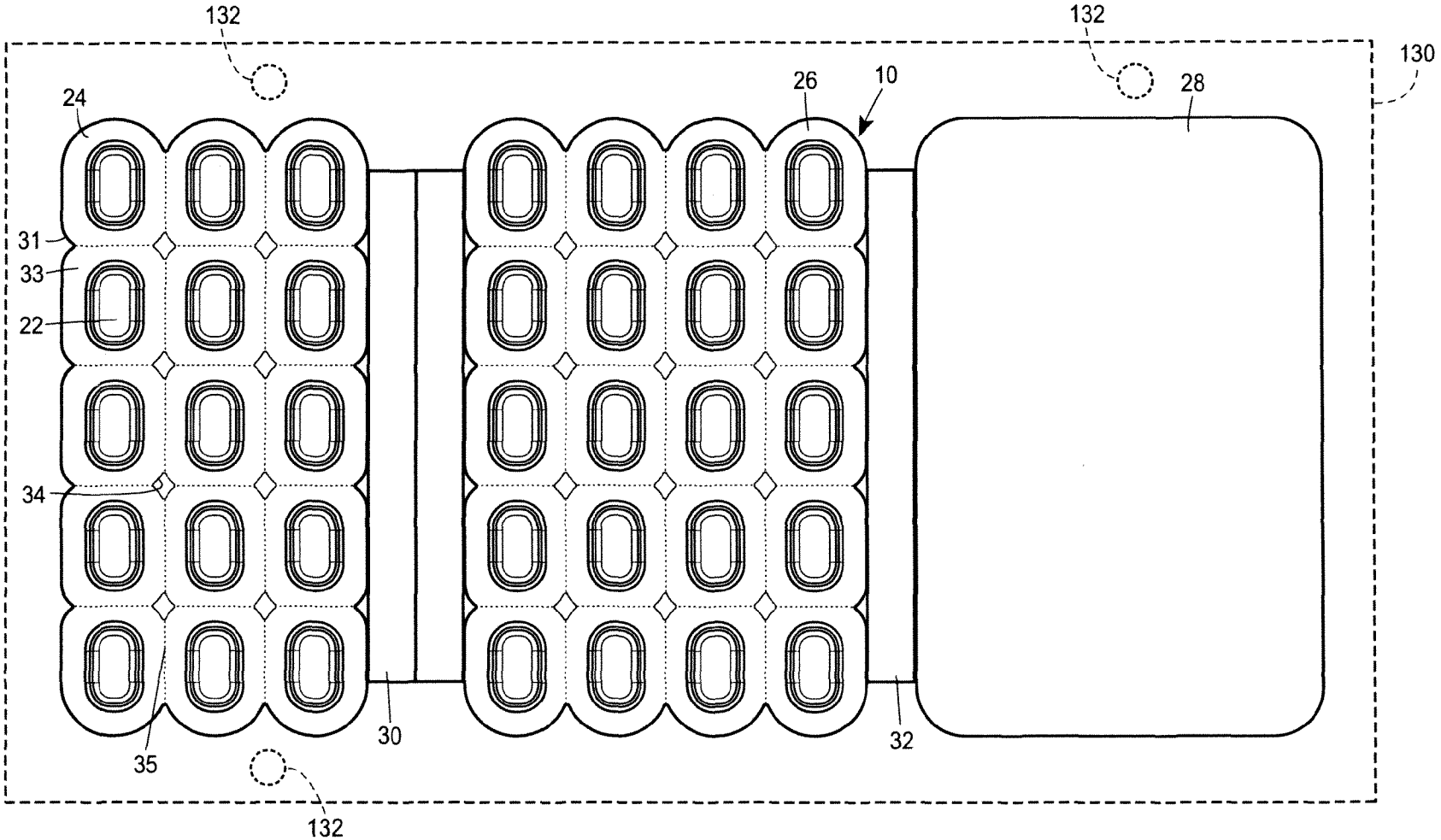
FIG. 1 is a plan view of one embodiment of a multi-dose blister card for use in describing the preferred embodiments of the method and apparatus of the present invention.
Figure 2:
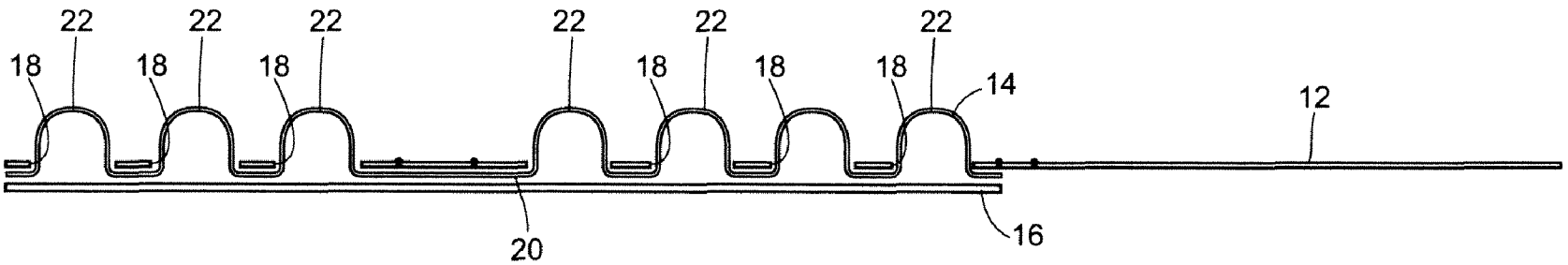
FIG. 2 is a partially exploded side cross-sectional view of the multi-dose blister card of FIG. 1.

FIGS. 1 and 2 depict one embodiment of a blister card 10 that will be used as an example for describing and illustrating the specific features of the present disclosure. In FIG. 1, the blister card 10 is depicted with solid lines. The phantom lines in FIG. 1 relate to an aspect of the disclosure that will be described below.

As depicted in FIG. 2, the example blister card 10 generally comprises a structure board 12, a blister sheet 14, and a backing layer 16. Preferably, the structure board 12 comprises a cardboard material defining a plurality of apertures 18. The blister sheet 14 comprises a conventional blister sheet, preferably constructed of a transparent plastic film material, for example, and defining a planar sheet portion 20 and a plurality of blisters 22. When assembled with the structure board 12, the blisters 22 of the blister sheet 14 are located within the apertures 18, as depicted in FIG. 2. The blister sheet 14 can then be affixed to the structure board 12, as will be described herein. So configured, the structure board 12 provides structural integrity to the blister card 10, and the blisters 22 can contain medicaments (not shown). In alternative embodiments, the blister card 10 can be constructed without a structure board 12, such that the blister sheet 14 provides the structural integrity to the blister card 10. The backing layer 16 in one form can include a foil material, which is ultimately affixed to the blister sheet 14 opposite the structure board 12 to seal the blisters 22. In other embodiments, the backing layer can include several different layers or a combination of layers such as paper and foil; or Teflon, paper, and foil. Moreover, in another embodiment, the package can have a layer of blister board on the bottom. In yet another embodiment, the backing layer 16 can include a layer of blister sheet material.

Referring back to FIG. 1, the example blister card 10 is arranged such that it may be folded in a tri-fold configuration. Specifically, the blister card 10 includes a first page portion 24, a second page portion 26, and a cover 28. The first and second page portions 24, 26 include a plurality of individual cells 33, each carrying a blister 22, and being separated by perforated seams 35. As depicted in FIG. 1, the present example of the blister card 10 includes rounded outside edges 31 and diamond-shaped openings 34 disposed between the cells 33 of the page portions 24, 26. The rounded edges 31 and the openings 34 can assist a user in tearing the perforated seams 35 to remove one or more individual cells 33 from the remainder of the page portions 24, 26 should the user wish to carry one or more cells 33 in his/her pocket without having to carry the entire blister card 10.

The first and second page portions 24, 26 are separated by a first spine 30 and the second page portion 26 and the cover 28 are separated by a second spine 32. The spines 30, 32 can include elongated depressions or indentations, for example, that enable the various portions 24, 26, 28 to be folded. For example, once the blister card 10 is fully loaded with the appropriate medicaments and thereafter sealed, the first page portion 24 can be folded at the first seam 30 to the right, relative to the orientation of FIG. 1, onto the second page portion 26 such that the blisters 22 of the first and second page portions 24, 26 become nested between and/or interleaved with each other. Then, the cover 28 can be folded to the left at the second seam 32, relative to the orientation of FIG. 1, such that the cover 28 covers the backside of the first page portion 24. This arrangement provides a simple, compact packaging that is similar to the various arrangements disclosed in the following commonly-owned U.S. patent applications, the entire contents of each of which are expressly incorporated herein by reference: U.S. Provisional Patent Application No. 60/940,790, filed May 30, 2007; U.S. Provisional Patent Application No. 60/947,169, filed Jun. 29, 2007; U.S. Provisional Patent Application No. 61/029,751, filed Feb. 19, 2008; U.S. patent application Ser. No. 12/130,365, filed May 30, 2008; U.S. patent application Ser. No. 12/130,140, filed May 30, 2008; U.S. patent application Ser. No. 12/130,400, filed May 30, 2008; U.S. patent application Ser. No. 12/130,489, filed May 30, 2008; U.S. patent application Ser. No. 12/130,575, filed May 30, 2008; and U.S. patent application Ser. No. 12/130,619, filed May 30, 2008. Therefore, it should be appreciated that the blister card 10 according to the present disclosure can include generally any type of blister card and is not limited to the blister card depicted in FIGS. 1 and 2, or the blister cards disclosed in the above-identified patent applications.

Figure 3:
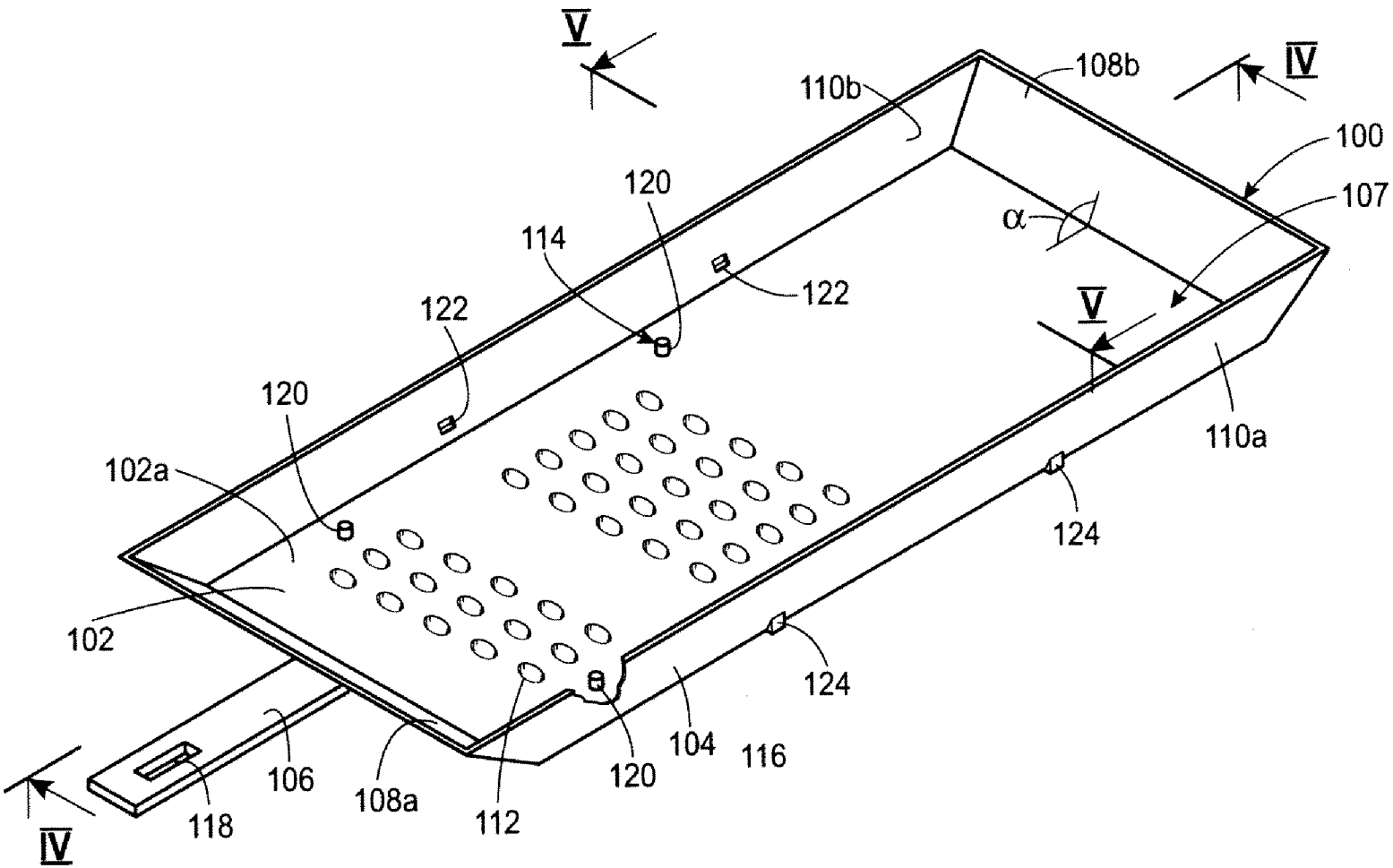
FIG. 3 is a perspective view of one embodiment of a fixture for preparing blister cards in accordance with the preferred embodiments of the method and apparatus of the present invention.
Figure 4:
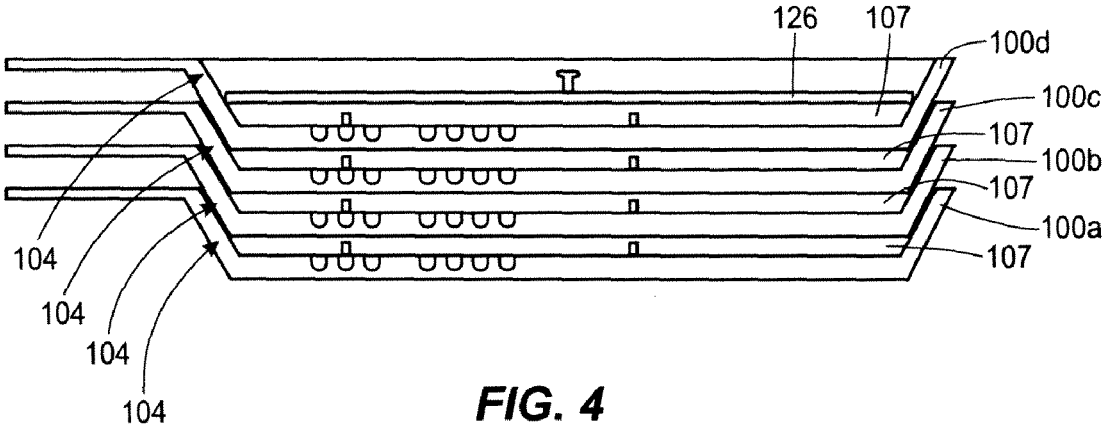
FIGS. 4 and 5 are cross-sectional side views of a plurality of the fixtures depicted in FIG. 3 shown in a stacked configuration.
Figure 5:
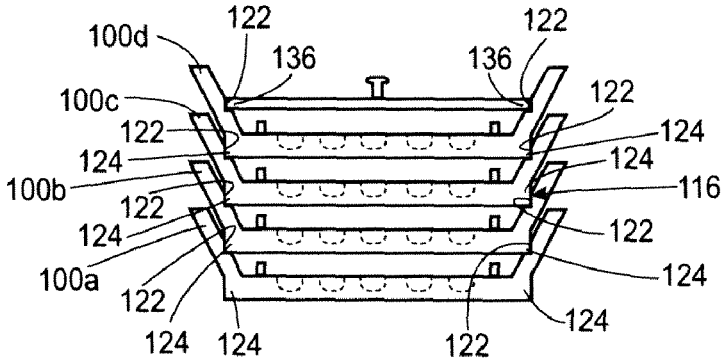

Referring now to FIG. 3, one embodiment of a fixture 100 adapted for use in preparing blister cards in accordance with the present disclosure will be described. The fixture 100 generally comprises a substantially planar support plate 102, a sidewall 104, a handle 106, and a cavity 107 defined between the support plate 102 and the sidewall 104. The support plate 102 is adapted to support a blister card 10 during a filling and heat sealing operation, as will be described. The sidewall 104 extends generally completely about the entire perimeter of the support plate 102 and comprises a pair of opposing end sidewall portions 108*a*, 108*b*, and a pair or opposing side sidewall portions 110*a*, 110*b*. In the depicted embodiment, the handle 106 extends away from one of the opposing end sidewall portions 110*a*, 110*b* of the sidewall 104 such that a user can grasp the handle 106 to transport the fixture 100. In alternative embodiments, the fixture 100 can have two handles 106, each extending from one of the opposing end sidewall portions 108*a*, 108*b* such that the fixture can be carried from both sides with two hands. The sidewall portions 108*a*, 108*b*, 110*a*, 110*b* are disposed at an obtuse angle $\alpha$, i.e., an angle between approximately ninety-degrees)(90° and approximately one-hundred and eighty degrees)(180°), relative to a top surface 102*a* of the support plate 102. So configured, the fixture 100 is adapted to be stacked with other identical fixtures, as depicted in FIGS. 4 and 5 and will be discussed below.

Still referring to FIG. 3, the fixture 100 further comprises a plurality of depressions 112, means for aligning a blister card 114, means for locating a fixture 116, and a data storage mechanism 118.

The plurality of depressions 112 are formed in the top surface 102*a* of the support plate 102, and arranged and configured to correspond to the arrangement of the blisters 22 on the blister card 10 depicted in FIGS. 1 and 2. Specifically, in this embodiment, the depressions 112 are generally arranged in a matrix, but other arrangements are intended to be within the scope of the disclosure. So configured, each of the plurality of depressions 112 are adapted to accommodate one blister 22 of the blister card 10 during the preparation process.

In the disclosed embodiment, the means for aligning a blister card 114 comprises a plurality of pins 120 extending upward from the top surface 102*a* of the support plate 102. In the present embodiment, the plurality of pins 120 comprises three pins, but other embodiments can comprises generally any number of pins. The pins 120 generally include cylindrical protrusions, and are adapted to align various components of the blister card 10 within the fixture 100. For example, the pins 120 can be configured so that the card can only fit over the pins when correctly positioned.

In the disclosed embodiment, the means for locating a fixture 116 comprises a plurality of recesses 122 and a plurality of projections 124. More specifically, the plurality of recesses 122 comprise two recesses formed in the inside surfaces of each of the two opposing side sidewall portions 110*a*, 110*b* of the sidewall 104. The plurality of projections 124 comprise two projections formed in the outside surfaces of each of the two opposing side sidewall portions 110*a*, 110*b* of the sidewall 104. In the disclosed embodiment, the recesses 122 comprise generally cylindrical recesses 122, and the projections 124 comprise generally cylindrical projections 124 adapted to fit within the recesses 122. In other embodiments, however, the recesses 122 and projections 124 can have generally any suitable shape. So configured, the recesses 122 of one fixture 100 are adapted to receive the projections 124 of another fixture 100 to locate the fixtures 100 relative to one another when stacked, as depicted in FIG. 5, thereby preventing undesired dislocation of the fixtures 100.

Referring back to FIG. 3, the data storage mechanism 118 of the first fixture can comprise a bar code, a radio-frequency identification (RFID) chip, or some other readable device capable of storing information such as patient information, prescription information, etc.

As mentioned, the fixture 100 disclosed herein is adapted to be stacked with other similar fixtures, as depicted in FIGS. 4 and 5. Specifically, one embodiment of a "system" for preparing blister cards can include four fixtures 100*a*-100*d*, and a cover plate 126. As such, when the fixtures 100*a*-100*d* are stacked, the projections 124 of the means for locating the fixtures 116 are disposed within the recesses 122 of the means for locating 116 (as shown in FIG. 5) such that the fixtures 110*a*-100*d* become interlocked with each other and can be transported as a single unit during the preparation process, for example. Moreover, as depicted in FIGS. 4 and 5, the cavities 107 of each of the fixtures 100*a*-100*d*, except for the top-most fixture 100*d*, receives the support plate 102 and at least a portion of the sidewall 104 of the immediately superior fixture 104. This also assists in maintaining the location of each fixture 100*a*-100*d* relative to the others, and is made possible by the angled disposition of the sidewall 104 relative to the support plate 102. Still further, the bottom of the plate positioned above will contact the top of the blister card in the plate below, thereby acting as a cover to prevent the pills from bouncing out of or otherwise leaving the blisters.

Figure 6:
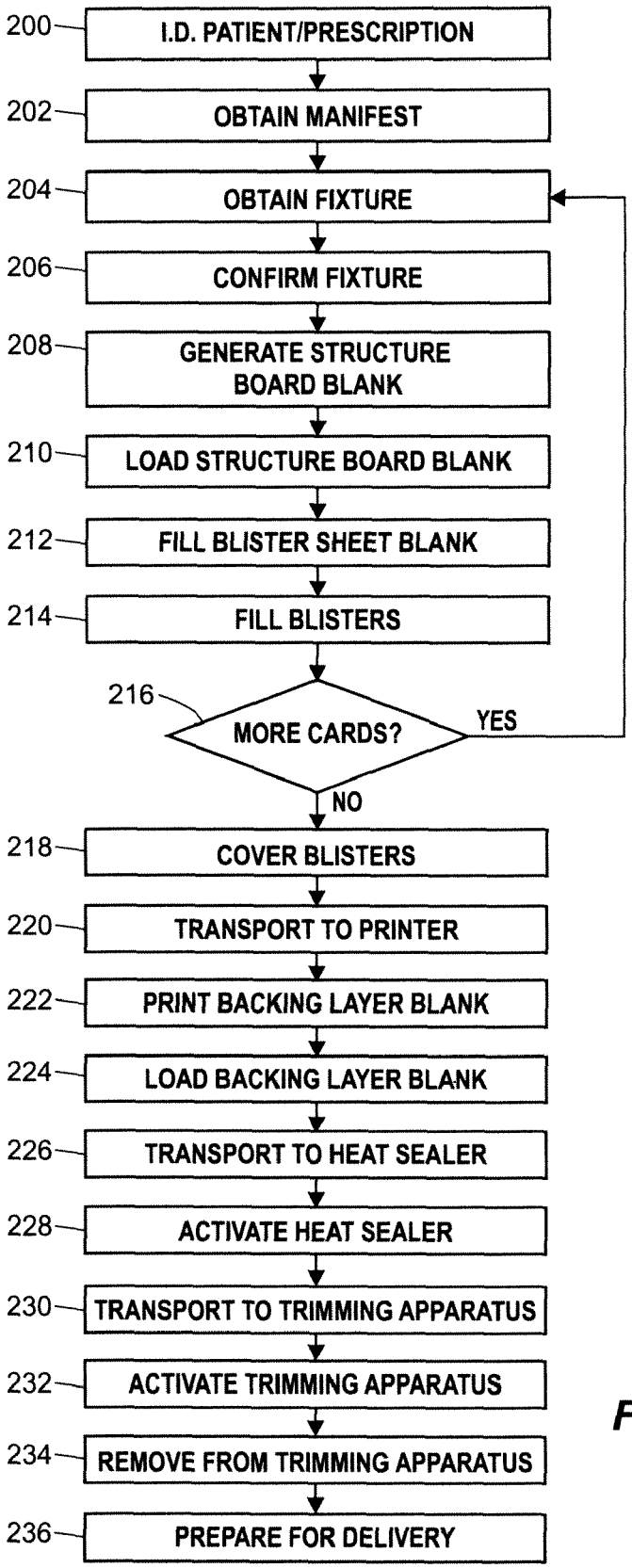
FIG. 6 is a flow chart of one preferred method of preparing blister cards.

Referring now to the flow diagram illustrated in FIG. 6, a method of preparing one or more blister cards using the above-described fixture 100 will be described. Initially, a technician such as a pharmacist identifies the patient and the prescription to be filled (block 200). This may occur through the use of a computer generated ticket, for example, that the patient hands over to the technician and the technician scans into a computer, or more simply, the technician may just select the patient's profile from a database stored in the computer. Once the patient is identified, the technician obtains a "manifest" that contains all of the necessary information for preparing the blister card 10 for the patient (block 202). The manifest can include a paper document or booklet, for example, that is stored in a file at the pharmacy, or it can be generated by the computer immediately after identifying the patient. Generally, the manifest can contain the patient's name and other personal information, the medicaments that have been prescribed to the patient, the specific regimen in accordance with which the patient is to ingest the medicaments, e.g., the days of the week and the times of day, and a data storage mechanism such as a bar code or RFID chip containing data specific to the patient and the specific prescription being filled. While the present embodiment is disclosed as including a data storage mechanism, alternative embodiments are not required to have one.

Figure 7:
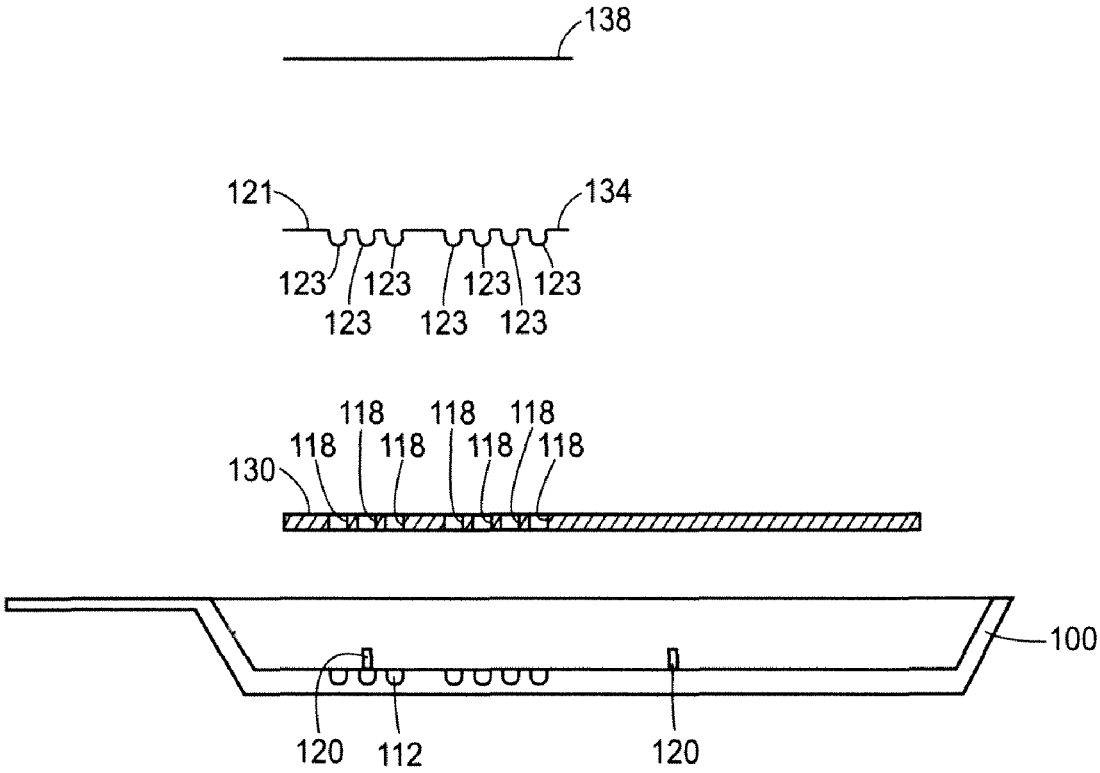
FIG. 7 is an exploded side cross-sectional representation of the various component parts of a blister card being prepared using a fixture in accordance with the preferred method and apparatus of the present invention.

After obtaining the manifest, the technician identifies and retrieves a fixture 100 associated with the prescription (block 204). Then, the technician associates the fixture 100 with the order by scanning the data storage mechanism 118 carried by the fixture 100, as well as the data storage mechanism carried by the manifest (block 206). If the data storage mechanisms comprise bar codes or RFID chips, the technician simply scans the bar codes with a bar code reader attached to the computer, or the RFID chips with an RFID reader attached to the computer. The computer then generates a structure board blank 130 (as shown in FIG. 7, for example) specific to the patient and the prescription being filled (block 208).

For example, the structure board blank 130 may be printed by the computer to include the patient's name, prescription information, and/or any other indicia. The structure board blank 130 comprises a single piece of cardboard, which ultimately becomes the structure board 12 of the finished blister card 10 described above with reference to FIGS. 1 and 2. As such, the structure board blank 130 is pre-formed to include the plurality of apertures 18 depicted in FIG. 2. Otherwise, the structure board blank 130 comprises a solid piece of cardboard sized larger than the finished blister card 10. For example, the hidden lines in FIG. 1 represent the outside dimensions of one embodiment of the structure board blank 130. The area of the structure board blank 130 extending between the edge of the blister card 10 and the hidden lines depicted in FIG. 1 can be referred to as a peripheral portion, which will ultimately be trimmed off during further processing, as will be described below. As is also depicted with hidden lines in FIG. 1, the peripheral portion of the structure board blank 130 includes three alignment openings 132. The alignment openings 132 are adapted to be positioned onto the pins 120 extending from the support plate 102 of the fixture 100, as will be described with reference to FIGS. 8 and 9. In one embodiment, the peripheral portion can also include pictures of the specific medicaments to be filled into the blister card and/or instructions for assembling the specific card.

Referring back to FIG. 6, with the structure board blank 130 in hand, the technician positions it into the cavity 107 of the fixture 100 such that the alignment openings 132 are positioned onto the pins 120 (block 210). In the disclosed embodiment, the three pins 120 ensure that the technician places the structure board blank 130 into the fixture 100 in the proper orientation. That is, the specific configuration of the pins 120 only allows for the structure board blank 130 to be placed in one orientation. In one embodiment, after the structure board blank 130 is positioned into the fixture 100, the technician scans yet another data storage mechanism that may be carried by the peripheral portion of the structure board blank 130 to confirm that the proper structure board blank 130 was loaded.

Figure 8:
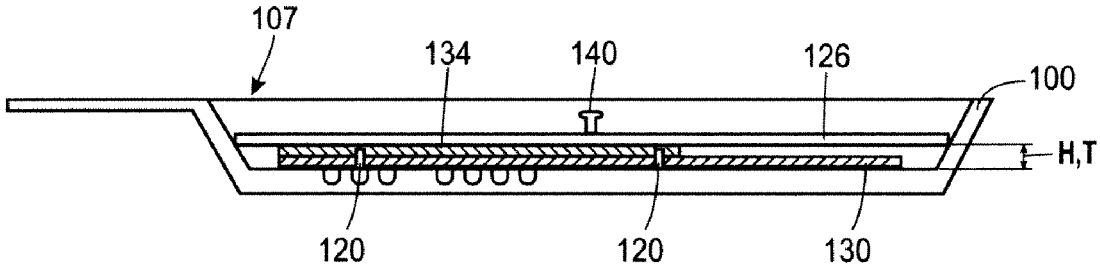
FIGS. 8 and 9 are side cross-sectional views of a fixture loaded with various component parts of a blister card being prepared in accordance with the preferred method and apparatus of the present invention.
Figure 9:
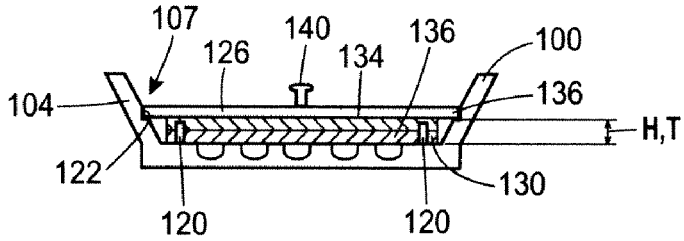

Next, the technician places a blister sheet blank 134 on top of the structure board blank 130 (block 212). The blister sheet blank 134 is generally similar to the blister sheet 14 described above with reference to FIG. 2 in that it comprises a planar sheet portion 121 and a plurality of blisters 123. When properly positioned on the pins 120, the blisters 123 of the blister sheet blank 134 fall into the depressions 112 formed in the top surface of the support plate 102 of the fixture 100, thereby allowing the planar sheet portion 121 to engage the structure board blank 130 in a generally flat configuration. It will be appreciated that the pins 120 are preferably sized to include a height H that is greater than the combined thicknesses T of the structure board blank 130 and blister sheet blank 134. So configured, the tops of the pins 120 are preferably disposed above the top surface of the blister sheet blank 134. In an alternative embodiment, the height H can be substantially equal to the thickness T, as illustrated in FIGS. 8 and 9, for example. In one embodiment, the blister sheet blank 134 is selected from a supply of blister sheet blanks 134 that are all identical. In another embodiment, the blister sheet blank 134 can be custom formed for the specific blister card 10 being prepared.

Now, with the structure board blank 130 and blister sheet blank 134 properly positioned in the fixture 100, the technician can begin filling the blisters 123 of the blister sheet blank 134 with the appropriate medicaments. In one embodiment, to determine exactly what medicaments go into what blisters 123, the technician refers to the manifest that was obtained at the beginning of the preparation process.

With the blisters 123 of the blister sheet blank 134 are filled with the appropriate medicaments, the technician refers back to the manifest and determines whether the specific prescription being filled requires more than one blister card 10 (block 216). If the prescription requires more than one blister card 10, the process returns to step 204 in FIG. 6 and the technician retrieves another fixture 100. The technician then repeats steps 208-214 for a second blister card 10. Once the second blister card 10 is filled, the technician stacks the second fixture 100 on top of the fixture containing the previously filled blister card 10, as illustrated in FIGS. 4 and 5, for example. The technician repeats steps 204-216 for each additional blister card 10 until no more blister cards remain to be filled. In alternative embodiments, the technician determines if additional blister cards are required, and sets up any additional fixtures, prior to filling the first blister card.

If the prescription only requires one blister card 10 to be created for the patient, the technician covers the filled blister sheet blank 134 with the cover plate 126 (block 218), as depicted in FIGS. 8 and 9. Specifically, the technician places the cover plate 126 into the cavity 107 defined by the fixture 100 such that projections 136 formed on the side edges thereof become seated in the recesses 122 formed in the inside surface of the sidewall 104, as depicted in FIG. 9. So situated, the bottom surface of the cover plate 126 engages the top surface of the blister sheet blank 134 and serves to retain the medicaments in the blisters 123. With the medicaments secured, the technician can transport the fixture 100 throughout the remainder of the process without contaminating or losing the medicaments. In an alternative embodiment, the technician may cover the blister sheet blank 134 with the manifest, instead of a cover plate 126.

After covering the blister sheet blank 134, the technician transports the fixture 100 to a backing layer printing machine (not shown) (block 220). At the backing layer printing machine, the technician again scans the data storage mechanism 118 carried by the fixture 100, or the data storage mechanism carried by the structure board blank 130, with a scanning device connected to the backing layer printing machine. Once scanned, the backing layer printing machine prints a custom backing layer blank 138 (shown in FIG. 7) for the blister card 10 (block 222). The custom backing layer blank 138 may be constructed of foil, paper, cardboard, or any other suitable material and can be custom printed to include medicament information and/or patient information such that when applied to the blister card 10, such information is presented on the backs of each of the individual cells 33 of the blister card 10 described herein with respect to FIG. 1, for example. Additionally, similar to the structure board blank 130 and blisters sheet blank 134 described above, one embodiment of the backing layer blank 138 includes a peripheral portion (not shown) such that the backing layer blank 138 has generally the same external dimensions as the blister sheet blank 134 described above.

With the backing layer blank 138 printed, the technician removes the cover plate 126 from the fixture 100 by grasping a handle 140 (shown in FIGS. 8 and 9) provided thereon. This exposes the blister sheet blank 134 and the contents of the blisters 123. Then, the technician positions the backing layer blank 138 onto the top surface of the blister sheet blank 134 such that the backing layer blank 138 covers the blisters 123 (block 224). In one embodiment, the backing layer blank 138 includes an indicator printed thereon, which indicates to the technician how to orient the backing layer blank 138 onto the blister sheet blank 134. For example, the backing layer blank 138 may include one or more arrows pointing to the left edge of the backing layer blank 138 to indicate to the technician that this edge is to be oriented adjacent the handle 106 of the fixture 100, for example. In other embodiments, the peripheral portion of the backing layer blank 138 can include openings that are adapted to be positioned on top of the pins 120 in a manner similar to the peripheral portions of the structure board blank 130 and the blister sheet blank 134.

With the backing layer blank 138 properly positioned on the blister sheet blank 134, the technician then moves the entire fixture 100 into a heat sealing machine to seal the structure board blank 130, blister sheet blank 134, and backing layer blank 138 together (block 226).

Figure 10:
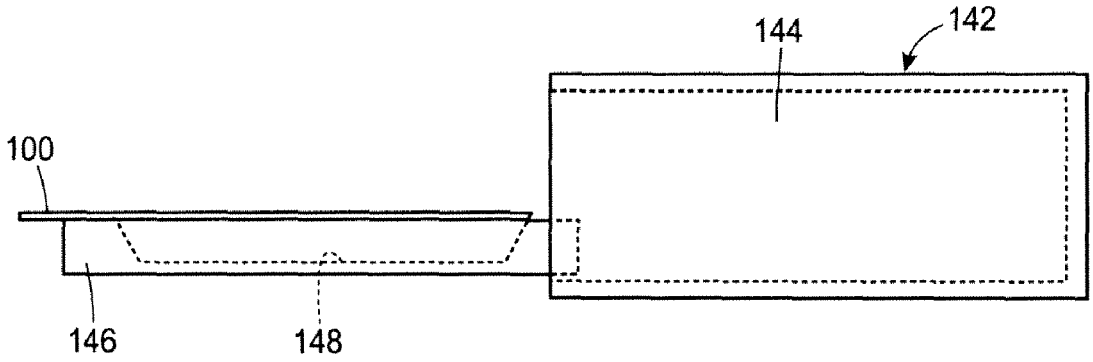
FIG. 10 is a schematic representation of a heat sealing apparatus used in one preferred method of the present invention.

FIG. 10 depicts one embodiment of a heat sealing machine 142 that could be used in the method according to the present disclosure. The heat sealing machine 142 includes a sealing chamber 144 and a roller drawer 146. The roller drawer 146 includes a recess 148 adapted to receive the fixture 100 as illustrated. The drawer 146 and fixture 100 can then be rolled into the sealing chamber 144. Once the fixture 100 is positioned in the sealing chamber 144, the machine will apply pressure and heat to seal the blister card 228. This pressure and heat ultimately seals the blister sheet blank 134 to the structure board blank 130, and the backing layer blank 138 to the blister sheet blank 134, thereby forming a unitary blister card (see, block 228 of FIG. 6) with the medicaments enclosed and sealed within the blisters 123.

Figure 11:
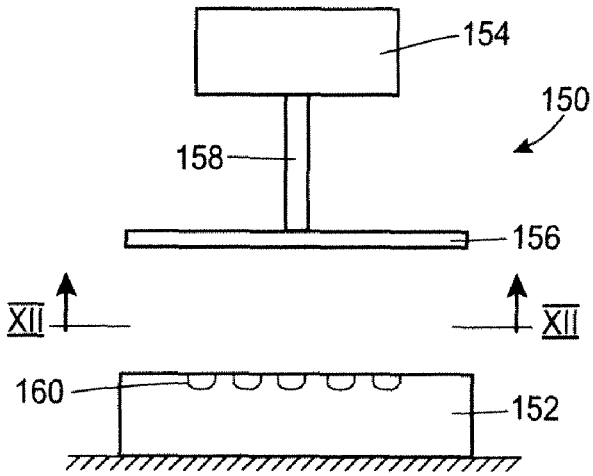
FIG. 11 is a schematic representation of a trimming and cutting apparatus used in one preferred method of the present invention.
Figure 12:
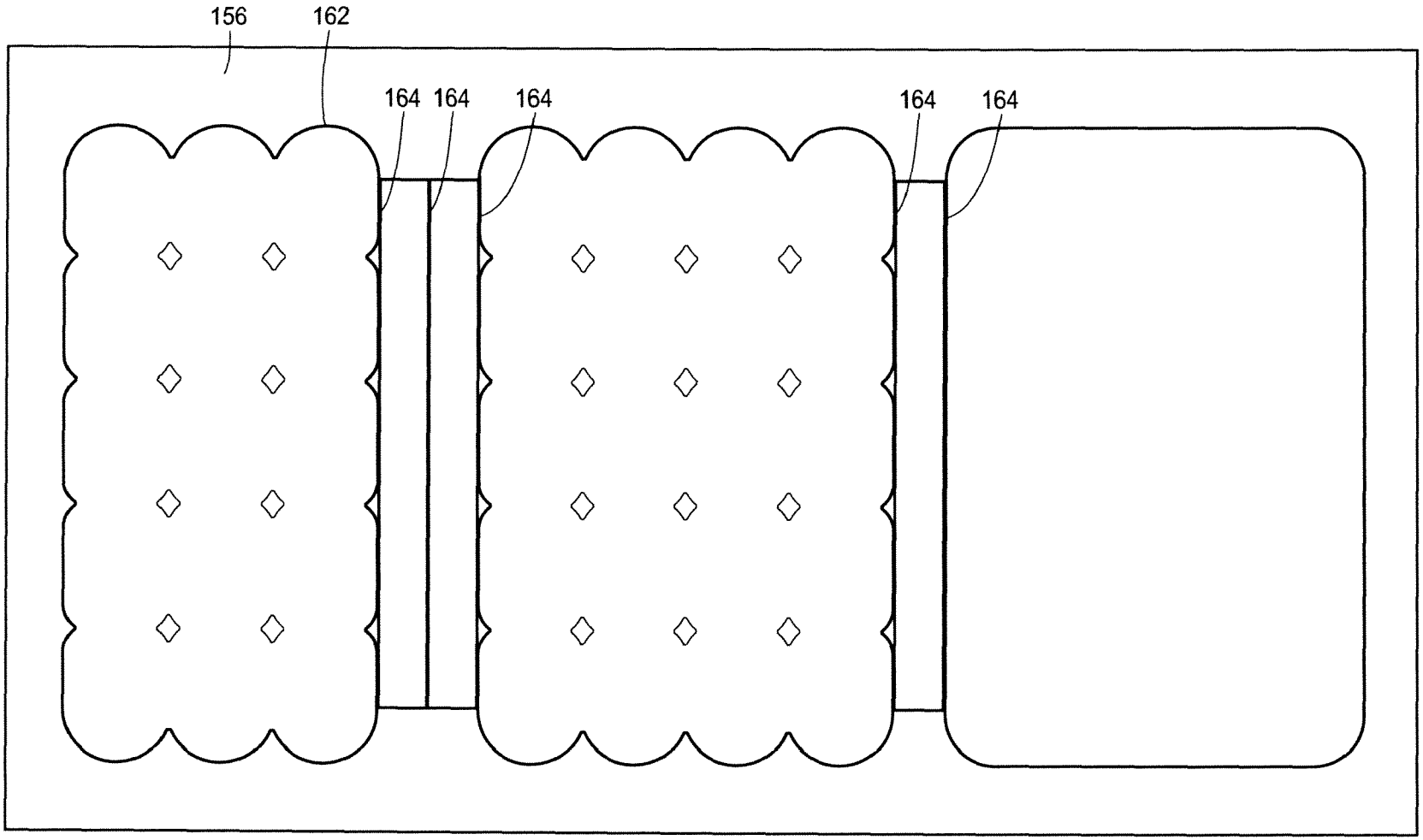
FIG. 12 is a plan view of the cutting/stamping surface of one die used in the trimming and cutting apparatus of FIG. 11 while performing one preferred method of the present invention.

Once sealed, the blister card is removed from the heat sealer 142 and transported to a trimming apparatus (block 230) such as the die cutting apparatus 150 depicted in FIG. 11. The die cutting apparatus 150 generally includes a work table 152, an actuator 154, and a die 156 operatively connected to the actuator 154 via a piston 158. The work table 152 includes a plurality of depression 160 arranged similar to the depressions 112 formed in the support plate 102 of the fixture 100. So configured, the blisters 123 of the sealed blister card can be positioned into the depressions 160 such that the sealed blister card is flatly supported on the work table 152. The actuator 154 can then be actuated to move the die 156 downward (block 232), relative to the orientation of FIG. 11, to engage the backing layer blank 138 of the sealed blister card. The actuator 154 preferably moves the die 156 with sufficient force to cut the backing layer blank 138, the blister sheet blank 134, and the structure board blank 130 into the desired final form of the blister card 10 depicted in FIG. 1. For example, one embodiment of the die 156, which is depicted in plan view in FIG. 12, includes a pattern of projections 162 that are sharpened to cut through and trim the various blanks to shape the blister card 10, as desired.

Specifically, the projections 162 are designed to cut the rounded edges 31 and diamond-shaped openings 34 between each of the individual cells 33. In addition to the pattern of sharpened projections 162, the die 156 includes a plurality of elongated projections 164 that are not sharpened, but rather, may be bull-nosed, for example. So configured, upon engagement with the blister card, the projections 164 do not cut through the various blanks, but instead, form elongated depressions, which can also be referred to as embossments, which then serve to facilitate folding of the various portions 24, 26, 28 of the blister card 10 along the spines 32, 34, as described above with reference to FIG. 1. In other embodiments, the die 156 can also include other pressing or cutting features to press or cut a company logo, for example, or other indicia into the blister card 10. In another embodiment, the work table 152 of the die cutting apparatus 150, instead of the die 156, can be equipped with either or both of the sharpened and elongate projections 152, 154. In one embodiment, the sealed blister card is preferably cut by the die cutting apparatus 150, which can also generally be referred to as a trimming apparatus, while the blister card is still warm from the heat sealer 142. Cutting the blister card while it is still warm can help prevent curling of the blister card, especially the blister sheet blank 134 and/or the backing layer blank 138, which can include materials that tend to contract while cooling. Thus, cutting the blister sheet blank 134 and/or the backing layer blank 134 while still warm and, in particularly, cutting the openings 34 while the materials are still warm can help to relieve the stresses caused by the cooling contraction. Additionally, the openings 34 can assist in enabling the blister sheet blank 134 and the other materials to cool more uniformly, which can also reduce curling and/or other forms of deformation.

After the die cutting apparatus 150 has been actuated and the blister card blanks cut and trimmed into the final desired shape of the blister card 10, the technician can remove the blister card 10 from the work table 152 (block 234). At this point, the blister card 10 is completely sealed such that the medicaments stored in the blisters 123 are safe from contamination. Prior to delivering the completed blister card to the customer/patient, however, the contents of the blisters can be verified by a pharmacist, or other authorized technician.

One additional aspect that may be performed in this preparation process includes readying the blister card 10 for delivery to the patient (block 236). This can include the technician transporting the blister card 10 to a delivery label preparation machine (not shown), which reads a data storage mechanism carried by the blister card 10 and prints a delivery label to be applied thereto.

As described above with reference to FIGS. 4 and 5, some orders require the patient to have multiple blister cards 10 constructed in accordance with the present disclosure. For the sake of description, one exemplary order can require four blister cards 10*a*-10*d*, each of which contains medicaments to be ingested by the patient at a specific time of day. For example, the patient can order a first blister card 10 that contains medicaments to be ingested in the morning, a second blister card 10 that contains medicaments to be ingested at lunch, a third blister card 10 that contains medicaments to be ingested in the afternoon, and a fourth blister card 10 that contains medicaments to be ingested in the evening.

The process of preparing each of the four blister cards 10 is generally identical to that which is described above, except that each fixture 100*a*-100*d* associated with the blister cards 10*a*-10*d* is not required to accommodate a separate cover plate 126. Rather, because the fixtures can be stacked, as illustrated in FIGS. 4 and 5, only the topmost fixture 100*d* requires a cover plate 126 to prevent contamination and loss of the medicaments stored in the blisters 123. This is because, as described above, the blisters 123 carried by the bottom three fixtures 100*a*-100*c* are covered by the bottoms of the support plates 102 of the top three fixtures 100*b*-100*d*, respectively. This can be understood from FIGS. 4 and 5; although FIGS. 4 and 5 do not include the structure board blank 130 and the blister sheet blank 134 for the sake of clarity.

From the foregoing, it should be appreciated that the present disclosure provides an efficient and effective method of preparing one or more blister cards for a specific patient's prescription through the use of one or more fixtures 100 that are adapted to carry various components of the blister card through various process steps. Specifically, the fixtures 100 are advantageously adapted to carry the structure board blank 130 and blister sheet blank 134 through the filling and heat sealing stages of the method. As such, preferably, the fixtures are constructed of a heat resistant, washable material such as aluminum, high density plastic, e.g., Lexan®, pressed cork, plywood, or generally any other material suitable for withstanding the pressure and heat generated within the disclosed heat sealing apparatus, or any other suitable heat sealing apparatus.

An additional feature that may be implemented into the system of fixtures 100 described herein for preparing multiple blister cards 10, is that each of the four fixtures 1001-110*d*, can be color-coded to avoid confusion as to which fixture is to be used for which blister card 10. For example, in one embodiment, the morning fixture could be yellow, the lunchtime fixture could be blue, the afternoon fixture could be purple, and the evening fixture could be black. This color scheme is merely an example. Any other color schemes could be utilized and are intended to be within the scope of the disclosure.

While the preparation process has been generally described herein as being conducted manually by a technician, the disclosure is also intended to include preparation processes that are fully automated. For example, in one automated preparation process, a machine retrieves the fixtures, loads the blanks into the fixtures, and fills the blisters. The machine can then transport the blisters to the printing, heat sealing, and trimming machines for completing the blister cards 10.

Furthermore, while the means for aligning a blister card 114 has been described herein as including a plurality of pins 120, a plurality of corresponding openings 132 formed in the structure board blank 130, the blister sheet blank 134, and the backing layer blank 138, it should be appreciated that alternative embodiments are not limited to such structures. Rather, alternative embodiments of the means for aligning the blister card 114 can include generally any shape projection and opening arrangement, whether the projection(s) be positioned on the fixture 100 or on the blanks 130, 134, 138. Additionally, the means for aligning the blister card 114 can include mechanisms other than projections and openings. For example, in one embodiment, the means for aligning the blister card 114 can include indicia or other markings provided on one or both of the fixture 100 and the blanks 130, 134, 138. In other embodiments, the means for aligning 114 may constitute light beams projected onto the fixture 100 and/or blanks 130, 134, 138 to indicate the proper orientation to the technician.

Similarly, while the means for locating the fixtures 116 described herein include the recesses 122 and projections 124 formed on the fixtures 100, alternative embodiments of the fixtures 100 can include other means for locating 116. For example, in one embodiment, the means for locating 116 can include external clamping mechanisms, for example, which hold the position of the stacked fixtures 100 relative one another. In another embodiment, the means for locating 116 may simply include the angled sidewalls 104 of the fixtures 100. Still further, the means for locating 116 may include a bead of friction generating material, such as silicone, for example, extending about the outside and/or inside surfaces of the sidewalls 104 to generate friction between adjacent fixtures 100, thereby retaining the stacked configuration.

Accordingly, it should be appreciated that neither the means for aligning 114 nor the means for locating 116 are intended to be limited to the identical structures depicted herein, or merely the equivalents of those structures, but rather, such means are intended to cover and encompass all structures that are capable of performing the respective functions.

Figure 13:
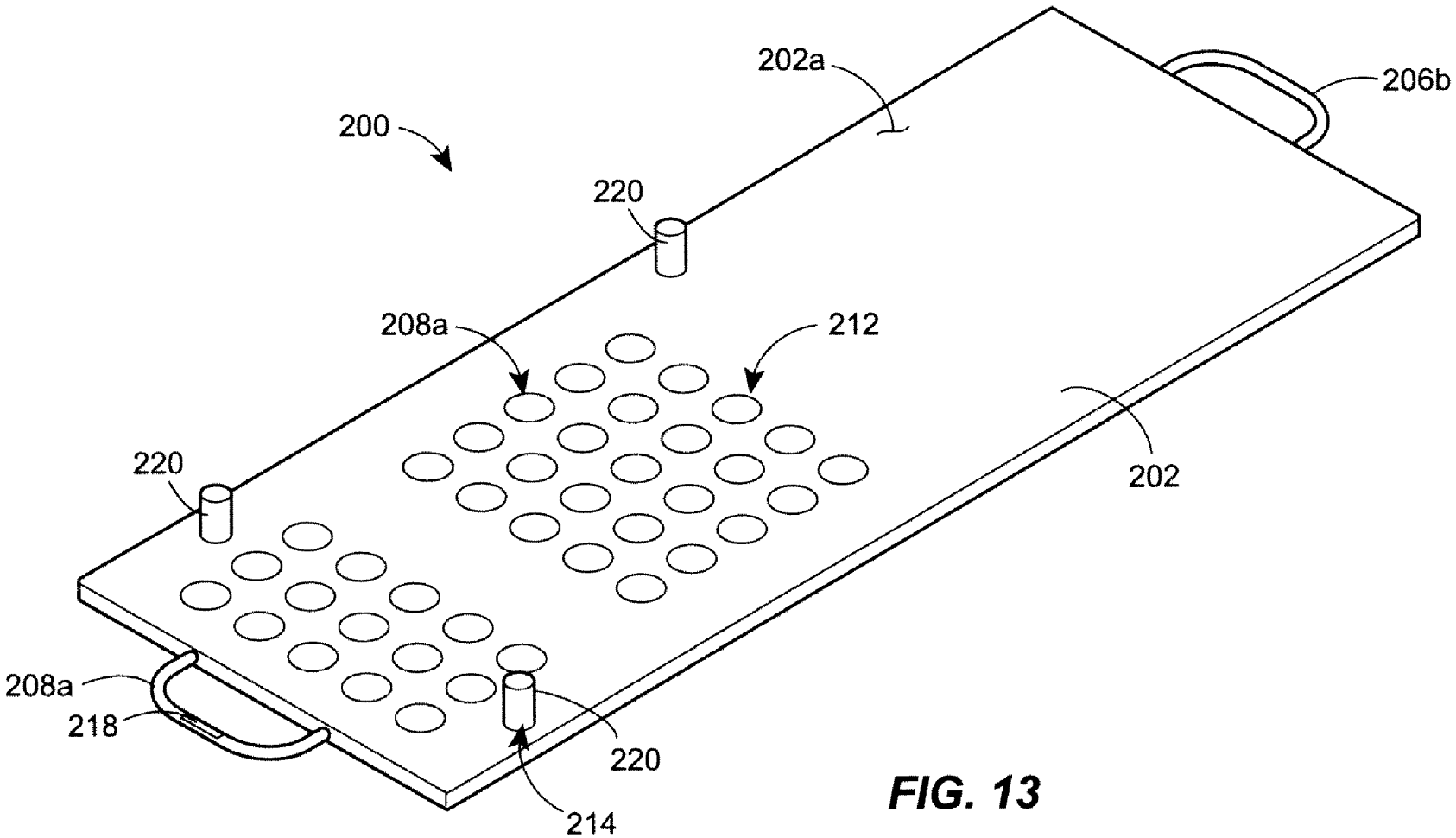
FIG. 13 is a perspective view of an alternative embodiment of a fixture for preparing blister cards in accordance with the preferred embodiments of the method and apparatus of the present invention.

Finally, while the fixtures 100 used for performing the method of the present disclosure have thus far been described in accordance with those depicted in FIGS. 3-5, alternative fixtures can also be used. For example, FIGS. 13-15 depict alternative fixtures 200 for preparing blister cards in accordance with the method described herein.

The fixtures 200 generally comprise a substantially planar support plate 202 and a pair of handles 206*a*, 206*b*. The support plate 202 is adapted to support a blister card 10 during a filling and heat sealing operation, in generally the same manner as described above with respect to the fixture 100. In this embodiment, the handles 206*a*, 206*b* extend from opposite ends of the support plate 202 such that a user can grasp them to transport the fixture 200. The fixture 200 further comprises a plurality of depressions 212 (shown in FIG. 13), means for aligning 214, and a data storage mechanism 218.

The plurality of depressions 212 are formed in a top surface 202*a* of the support plate 202, and arranged and configured to correspond to the arrangement of the blisters 22 on the blister card 10 depicted in FIGS. 1 and 2 in a manner identical to the depressions 112 described above with reference to the fixture 100 depicted in FIG. 3. The means for aligning 214 comprises a plurality of pins 220, which may also be referred to as projections, extending upward from the top surface 202*a* of the support plate 202. In the present embodiment, the plurality of pins 220 comprises three pins, but other embodiments can comprises generally any number of pins. The pins 220 generally include cylindrical protrusions, and are adapted to align various components of the blister card 10 on the fixture 200, as well as multiple fixtures 200 relative to each other, as will be described. In one example, the pins 220 can be configured so that the blister card can only fit over the pins 220 when correctly positioned.

Figure 14:
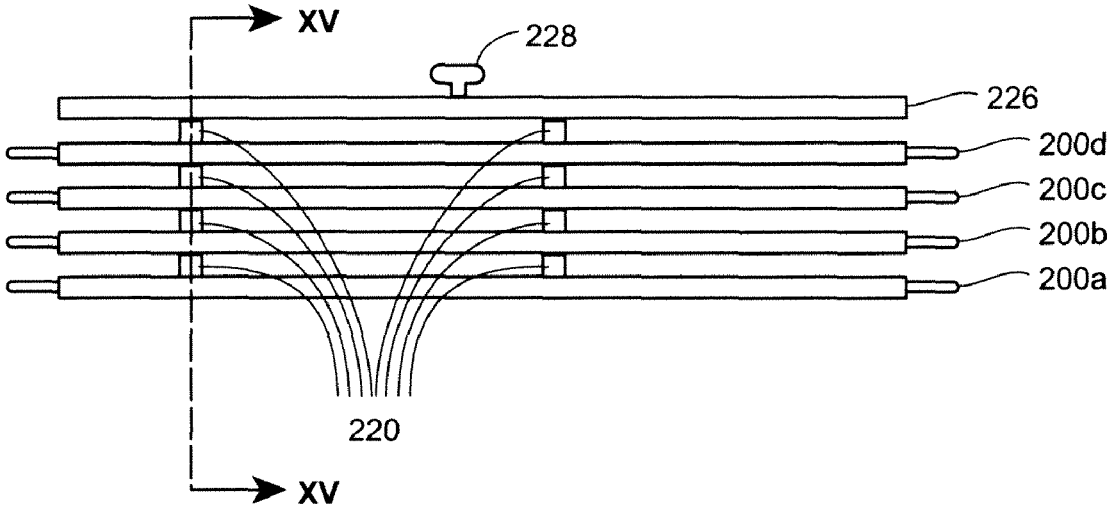
FIG. 14 is a side view of a plurality of the fixtures depicted in FIG. 13 shown in a stacked configuration.
Figure 15:
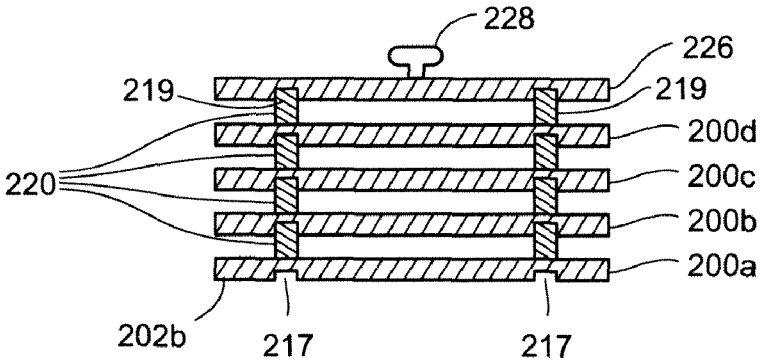
FIG. 15 is a side cross-sectional view of the plurality of the fixtures depicted in FIG. 14 taken through line XV-XV of FIG. 14.

As mentioned, the fixture 200 disclosed herein is adapted to be stacked with other similar fixtures, as depicted in FIGS. 14 and 15. To facilitate this stacking, each fixture 200 includes a plurality of recesses 217 formed in a bottom surface 202*b* of the support plate 202, as depicted in FIG. 15. The plurality of recesses 217 in one fixture 200 are adapted to receive the plurality of pins 220 of another fixture 200, thereby stacking the fixtures 200 in an aligned configuration. As such, the present embodiment of the fixture 200 includes three recesses 217 corresponding to the three pins 220.

Similar to that described above with respect to FIGS. 4 and 5, one embodiment of a "system" for preparing blister cards can include four fixtures 200*a*-200*d*, and a cover plate 226. The cover plate 226 is generally a flat plate with recesses 219 that mirror the recesses 217 in the fixtures 200, and a handle 228 for moving the cover plate 226. When the fixtures 200*a*-200*d* are stacked, the pins 220 are disposed within the recesses 217 in the support plates 202 such that the fixtures 200*a*-200*d* become interlocked with each other and can be transported as a single unit during the preparation process, for example. Although FIGS. 14 and 15 do not depict the blister card 10 disposed on the fixtures 200*a*-200*d*, it should be appreciated that this configuration enables the bottom of each fixture 200 to contact the top of the blister card 10 in the fixture 200 positioned immediately below. Thus, each fixture 200, except fixture 200*a* in FIGS. 14 and 15, acts as a cover to prevent the medicaments from bouncing out of or otherwise leaving the blisters of the blister card below. Moreover, because the top fixture 200*d* is not covered by another fixture, the cover plate 226 is positioned on the pins 220 thereof to secure the medicaments from bouncing out of the blister card stored thereon. Thus, although designed differently, the fixtures 200 depicted in FIGS. 13-15 can be used to perform the method of preparing a blister card described above with respect to FIG. 6, for example.

Accordingly, it should be appreciated that the present invention is not limited or defined by the embodiments described in the specification. These are merely examples of what is defined by the appending claims.

What is claimed is:

1. A method of preparing a blister card using a fixture to contain medicaments in accordance with a predetermined prescription, the method comprising:

aligning a plurality of blisters of a blister sheet blank with a plurality of depressions formed in a top surface of a support plate of a first fixture;

filling at least some of the blisters of the blister sheet blank with one or more medicaments;

stacking a plate on the blister sheet blank to prevent contamination and to retain the one or more medicaments in the at least some blisters of the blister sheet blank;

transporting the first fixture, the blister sheet blank, the one or more medicaments, and the stacked plate;

removing the date from the blister sheet blank to expose the blister sheet blank and the one or more medicaments;

covering the blister sheet blank with a backing layer blank;

applying at least one of pressure and heat to the backing layer blank, the blister sheet blank, and the first fixture to seal the backing layer blank and the blister sheet blank together.

2. The method of claim 1, wherein aligning the plurality of blisters in the blister sheet blank with the plurality of depressions comprises positioning one or more openings formed in the blister sheet blank onto one or more pins extending from the first fixture.

3. The method of claim 1, further comprising printing information specific to the prescription on the backing layer blank prior to covering the blister sheet blank with the backing layer blank.

4. The method of claim 1, further comprising trimming the sealed backing layer blank and the blister sheet blank to a predetermined shape, thereby defining a backing layer and blister sheet of a completed blister card.

5. The method of claim 1, further comprising reading information from at least one data storage mechanism on at least one of the first fixture, the blister sheet blank, and the backing layer blank to confirm that each of these components match the predetermined prescription prior to sealing the backing layer blank and the blister sheet blank together.

6. The method of claim 1, further comprising aligning a plurality of apertures of a structure board blank with the plurality of depressions in the top surface of the support plate of the first fixture prior to aligning the plurality of blisters of the blister sheet blank with the plurality of depressions.

7. The method of claim 6, wherein aligning the plurality of blisters of the blister sheet blank with the plurality of depressions in the first fixture comprises positioning the plurality of blisters through the plurality of apertures in the structure board blank.

8. The method of claim 1, wherein the plate comprises a support plate of a second fixture that is constructed the same as the first fixture.

9. The method of claim 1, wherein the plate comprises a cover plate that is constructed different than the first fixture.

10. A method of preparing a plurality of blister cards to contain medicaments according to a predetermined prescription, the method comprising:

selecting a first fixture having a support plate;

positioning a first blister sheet blank having a first plurality of blisters onto the support plate of the first fixture;

at least partially filling at least some of the first plurality of blisters of the first blister sheet blank with medicaments;

selecting a second fixture having a support plate;

locating the second fixture onto the first fixture such that the support plate of the second fixture covers the first blister sheet blank to prevent contamination and to retain the medicaments in the first plurality of blisters;

positioning a second blister sheet blank having a second plurality of blisters onto the support plate of the second fixture;

at least partially filling at least some of the second plurality of blisters of the second blister sheet blank with medicaments; and covering the second blister sheet blank to prevent contamination and to retain the medicaments in the second plurality of blisters.

11. The method of claim 10, wherein locating the second fixture onto the first fixture comprises positioning one of a projection and a recess of the second fixture in cooperative engagement with the other of a projection and a recess of the first fixture.

12. The method of claim 10, wherein locating the second fixture onto the first fixture further comprises engaging the first blister sheet blank with a bottom surface of the support plate of the second fixture.

13. The method of claim 10, wherein positioning the first and second blister sheet blanks onto the first and second structure board blanks, respectively, comprises aligning at least one opening formed in the first and second blister sheet blanks with at least one pin extending from the first and second fixtures.

14. The method of claim 10, further comprising covering the second blister sheet blank with a second backing layer blank and applying at least one of heat and pressure to the second backing layer blank, the second blister sheet blank, and the second fixture, thereby sealing these components together to form a sealed blister card.

15. The method of claim 14, further comprising trimming the sealed second backing layer blank and second blister sheet blank to a predetermined shape, thereby defining a backing layer and blister sheet of a completed blister card.

* * * * *